US009475281B2

(12) United States Patent
Clippingdale, Jr. et al.

(10) Patent No.: US 9,475,281 B2
(45) Date of Patent: Oct. 25, 2016

(54) METHOD OF OPERATING AN ELECTROSTATIC PRINTHEAD

(71) Applicant: TONEJET LIMITED, Royston, Hertfordshire (GB)

(72) Inventors: Andrew John Clippingdale, Jr., Royston (GB); Ammar Lecheheb, Royston (GB); John Lawton Sharp, Royston (GB)

(73) Assignee: Tonejet Limited, Royston, Hertfordshire (GB)

( * ) Notice: Subject to any disclaimer, the term of this patent is extended or adjusted under 35 U.S.C. 154(b) by 0 days.

(21) Appl. No.: 14/895,689

(22) PCT Filed: Jun. 4, 2014

(86) PCT No.: PCT/GB2014/000211
§ 371 (c)(1),
(2) Date: Dec. 3, 2015

(87) PCT Pub. No.: WO2014/195664
PCT Pub. Date: Dec. 11, 2014

(65) Prior Publication Data

US 2016/0121603 A1 May 5, 2016

(30) Foreign Application Priority Data

Jun. 4, 2013 (GB) ..... 1309943.7

(51) Int. Cl.
*B41J 2/045* (2006.01)
*B41J 2/06* (2006.01)

(52) U.S. Cl.
CPC ..... *B41J 2/04511* (2013.01); *B41J 2/04586* (2013.01); *B41J 2/06* (2013.01); *B41J 2002/062* (2013.01)

(58) Field of Classification Search
CPC .... B41J 2/04511; B41J 2/04586; B41J 2/06; B41J 2002/062
See application file for complete search history.

(56) References Cited

U.S. PATENT DOCUMENTS 5,852,453 A * 12/1998 Hirahara ..... B41J 2/06 347/55
2007/0200898 A1* 8/2007 Ueno ..... B05B 5/0255 347/55
2009/0096837 A1* 4/2009 Kubo ..... B41J 2/085 347/55

FOREIGN PATENT DOCUMENTS

JP H09 99562 A 4/1997

* cited by examiner

*Primary Examiner* — Bradley Thies
(74) *Attorney, Agent, or Firm* — Dickinson Wright PLLC

(57) ABSTRACT

A method of reducing and/or preventing the accumulation of concentrated ink at an ejection point of a printhead of an electrostatic inkjet printer when ink is not being ejected at the ejection point, the method comprising reversing the electric field at the ejection point of the printhead during a non-printing phase of operation to reduce the concentration of ink at the ejection point.

22 Claims, 7 Drawing Sheets

METHOD OF OPERATING AN ELECTROSTATIC PRINTHEAD

FIELD OF THE INVENTION

The present invention relates to electrostatic inkjet print technologies and, more particularly, to printheads and printers of the type such as described in WO/93/11866 and related patent specifications and their methods of operation.

BACKGROUND

Electrostatic printers of this type eject charged solid particles dispersed in a chemically inert, insulating carrier fluid by using an applied electric field to first concentrate and then eject the solid particles. Concentration occurs because the applied electric field causes electrophoresis and the charged particles move in the electric field towards the substrate until they encounter the surface of the ink. Ejection occurs when the applied electric field creates an electrophoretic force that is large enough to overcome the surface tension. The electric field is generated by creating a potential difference between the ejection location and the substrate; this is achieved by applying voltages to electrodes at and/or surrounding the ejection location.

The location from which ejection occurs is determined by the printhead geometry and the location and shape of the electrodes that create the electric field. Typically, a printhead consists of one or more protrusions from the body of the printhead and these protrusions (also known as ejection upstands) have electrodes on their surface. The polarity of the bias applied to the electrodes is the same as the polarity of the charged particle so that the direction of the electrophoretic force is away from the electrodes and towards the substrate. Further, the overall geometry of the printhead structure and the position of the electrodes are designed such that concentration and then ejection occurs at a highly localised region around the tip of the protrusions.

The ink is arranged to flow past the ejection location continuously in order to replenish the particles that have been ejected. To enable this flow the ink must be of a low viscosity, typically a few centipoises. The material that is ejected is more viscous because of the higher concentration of particles due to selective ejection of the charged particles; as a result, the technology can be used to print onto non-absorbing substrates because the material will not spread significantly upon impact.

Various printhead designs have been described in the prior art, such as those in WO 93/11866, WO 97/27058, WO 97/27056, WO 98/32609, WO 98/42515, WO 01/30576 and WO 03/101741.

WO 98/42515 proposes a system for controlling the application of first voltage pulses to a respective ejection electrode associated with an ejection location and second voltage pulses to a respective secondary electrode associated with the ejection location, such that, when a voltage pulse is applied to the ejection electrode, a voltage pulse, inverted with respect to the pulse applied to the ejection electrode, is applied to the secondary electrode. This technique is used to overcome the capacitive coupling between proximate ejection locations which otherwise can adversely effect ejection. This coupling can be reduced if lower voltages are used, and it is therefore desirable to use the smallest possible voltages to cause ejection. Inverting the voltage applied to the secondary electrode maintains the differential voltage at a desirable level while reducing the amplitude of the voltage change required on each electrode. The provision of voltages on secondary electrodes of this type also serves to preserve a symmetrical electrical field shape which minimises the deflection (side-to-side) resulting otherwise from asymmetrical fields arising from the voltages applied to adjacent ejection locations.

FIG. 1 is a drawing of the tip region of an electrostatic printhead 1 of the type described in this prior art, showing several ejection upstands 2 each with a tip 21. Between each two ejection upstands is a wall 3, also called a cheek, which defines the boundary of each ejection cell 5 or ejector. In each cell, ink flows in the two channels 4, one on each side of the ejection upstand 2 and in use the ink meniscus is pinned between the top of the cheeks and the top of the ejection upstand. In this geometry the positive direction of the z-axis is defined as pointing from the substrate towards the printhead, the x-axis points along the line of the tips of the ejection upstands and the y-axis is perpendicular to these.

FIG. 2 is a schematic diagram in the x-z plane of a single ejection cell 5 in the same printhead 1, looking along the y-axis taking a slice through the middle of the tips of the upstands 2. This figure shows the cheeks 3, the ejection upstand 2, the ejection location 6, the location of the ejection electrodes 7 and the position of the ink meniscus 8. The solid arrow 9 shows the ejection direction and also points towards the substrate. Typically, the pitch between the ejection cells is 168 μm. In the example shown in FIG. 2 the ink usually flows into the page, away from the reader.

FIG. 3 is a schematic diagram of the same printhead 1 in the y-z plane showing a side-on view of an ejection upstand along the x-axis. This figure shows the ejection upstand 2, the location of the electrode 7 on the upstand and a component known as an intermediate electrode (abbreviated to IE) (10). The intermediate electrode 10 is a structure that has electrodes 101, on its inner face (and sometimes over its entire surface), that in use are biased to a different potential from that of the ejection electrodes 7 on the ejection upstands 2. The intermediate electrode 10 may be patterned so that each ejection upstand 2 has an electrode facing it that can be individually addressed, or it can be uniformly metallised such that the whole surface of the intermediate electrode 10 is held at a constant bias. The intermediate electrode 10 acts as an electrostatic shield by screening the ejection location/ejector from external electric fields and allows the electric field at the ejection location 6 to be carefully controlled.

The solid arrow 11 shows the ejection direction and again points in the direction of the substrate. In FIG. 3 the ink usually flows from left to right.

In operation, it is usual to hold the substrate at ground (0 V), and apply a voltage, $V_{IE}$, between the intermediate electrode 10 and the substrate. A further potential difference of $V_B$ is applied between the intermediate electrode 10 and the electrodes 7 on the ejection upstand 2 and the cheeks 3, such that the potential of these electrodes is $V_{IE}+V_B$. The magnitude of $V_B$ is chosen such that an electric field is generated at the ejection location 6 that concentrates the particles, but does not eject the particles. Ejection spontaneously occurs at applied biases of $V_B$ above a certain threshold voltage, $V_S$, corresponding to the electric field strength at which the electrostatic force on the ink exactly balances the opposing force from the surface tension of the ink. It is therefore always the case that $V_B$ is selected to be less than $V_S$. Upon application of $V_B$, the ink meniscus moves forwards to cover more of the ejection upstand 2. To eject the concentrated ink, a further voltage pulse of amplitude $V_P$ is applied to the ejection upstand 2, such that the potential difference between the ejection upstand 2 and the intermediate electrode 10 is $V_B+V_P$. Ejection will continue for the duration of the voltage pulse. Typical values for these biases are $V_{IE}$=600 V, $V_B$=1000 V and $V_P$=300 V.

The voltages applied during print operation may be derived from the bit values of the individual pixels of a bit-mapped image to be printed. The bit-mapped image is created or processed using conventional design graphics software such as Adobe Photoshop and saved to memory from where the data can be output by a number of methods (parallel port, USB port, purpose-made data transfer hardware) to the print head drive electronics, where the voltage pulses which are applied to the ejection electrodes of the printhead are generated.

Printheads comprising any number of ejectors can be constructed by fabricating numerous cells 5 of the type shown in FIGS. 1 to 3 side-by-side along the x-axis. A controlling computer converts image data (bit-mapped pixel values) stored in its memory into voltage waveforms (commonly digital square pulses) that are supplied to each ejector individually. By moving the printhead 1 relative to the substrate in a controllable manner, large area images can be printed onto the substrate.

The electric field at the ejection points of the printhead, or of the channel, normally acts to force the colorant particles suspended in the ink towards the ejection point, creating a concentration of particles at the ejection point. When a channel prints, this concentration of particles is ejected from the head to the substrate. However, if a channel is not required to print for a period of time, evaporation of the carrier fluid may cause a layer of concentrated ink to form at the ejection point which can impede the ejection of ink when a print voltage is next applied to the channel for print operation.

This may result in a printhead being slow to respond to the start of printing an image. This effect is stronger if the bias voltage of the printhead has been on for a period of time prior to the start of printing.

Accordingly, there is a need to provide a method for reducing and/or preventing the above process which occurs when the printhead has not printed for a period of time, and an electrostatic inkjet printer which is not susceptible to said effect.

SUMMARY OF THE INVENTION

In accordance with an aspect of the present invention, a method of reducing and/or preventing the accumulation of concentrated ink at an ejection point of a printhead of an electrostatic inkjet printer when ink is not being ejected at the ejection point is provided, the method comprising reversing the electric field at the ejection point of the printhead during a non-printing phase of operation to reduce the concentration of ink at the ejection point.

Preferably, the printhead further comprises an ejection electrode.

Preferably, the printhead further comprises an intermediate electrode.

Preferably the electrostatic inkjet printer further comprises an intermediate electrode supply for supplying a voltage to the intermediate electrode of the printhead.

Preferably, the electrostatic inkjet printer further comprises a bias supply for supplying a voltage to the ejection electrode of the printhead.

Preferably, one of a negative or a positive terminal of the bias supply is referenced to ground. This allows the reversal of the electric field by reducing the bias supply voltage to less than the intermediate electrode supply voltage.

Preferably, the negative terminal is referenced to ground where the ink being ejected is positively charged and the positive terminal is referenced to ground where the ink being ejected is negatively charged.

Preferably, the step of reversing the electric field at the ejection point comprises switching the voltage of the bias supply from a printing phase voltage to a non-printing phase voltage.

Preferably, the printing phase voltage of the bias supply is greater than the voltage of the intermediate electrode supply and the non-printing phase voltage of the bias supply is lower than the voltage of the intermediate electrode supply.

Preferably, the electrostatic inkjet printer further comprises a clamping transistor.

Preferably, the step of reversing the electric field at the ejection point comprises switching the transistor to short-circuit the bias supply to ground. This is a quick and simple method for reducing the bias voltage to zero at the printhead. It avoids adding complexity to the power supply and can operate at high speed.

Preferably, the duration of the reversal of electric field is between 0.01 and 1 seconds.

Preferably, the duration of the reversal of electric field is between 0.05 and 0.2 seconds.

Preferably, the reversal of electric field occurs whenever the electrostatic inkjet printer is in a non-printing phase for longer than 0.01 seconds.

In accordance with a further aspect of the invention, a method of reducing and/or preventing the accumulation of concentrated ink at an ejection point of a printhead of an electrostatic inkjet printer when ink is not being ejected at the ejection point is provided, the method comprising reducing the electric field at the ejection point of the printhead during a non-printing phase of operation to reduce the concentration of ink at the ejection point.

Preferably, the printhead further comprises an ejection electrode.

Preferably, the printhead further comprises an intermediate electrode.

Preferably, the electrostatic inkjet printer further comprises a bias supply for supplying a voltage to the ejection electrode of the printhead.

Preferably, the electrostatic inkjet printer further comprises an intermediate electrode supply for supplying a voltage to the intermediate electrode of the printhead.

Preferably, the electric field at the ejection point is reduced to zero.

Preferably, the electric field at the ejection point is reversed.

In accordance with a further aspect of the invention, an electrostatic inkjet printer is provided comprising: a bias supply for supplying a voltage to an ejection electrode; an intermediate electrode supply for supplying a voltage to an intermediate electrode, wherein one of a negative or a positive terminal of the bias supply is referenced to ground; and an electrostatic printhead comprising; an ejection electrode; an intermediate electrode.

Preferably, the negative terminal is referenced to ground where the ink is positively charged and the positive terminal is referenced to ground where the ink being ejected is negatively charged.

Preferably, the bias supply of the electrostatic inkjet printer is controllable by a software interface which sets the output to a desired voltage at any point in time and/or which switches the supply off in a non-printing phase.

Preferably, the electrostatic inkjet printer further comprises a clamping transistor connected to short-circuit the bias supply to ground.

The invention defined above advantageously provides a method and an electrostatic inkjet printer suitable for performing said method which prevents the accumulation of concentrated ink at an ejection point of an electrostatic printhead when ink is not being ejected at the ejection point.

DESCRIPTION OF THE DRAWINGS

Examples of methods and apparatus according to the present invention will now be described with reference to the accompanying drawings, in which.

DETAILED DESCRIPTION

Figure 4:
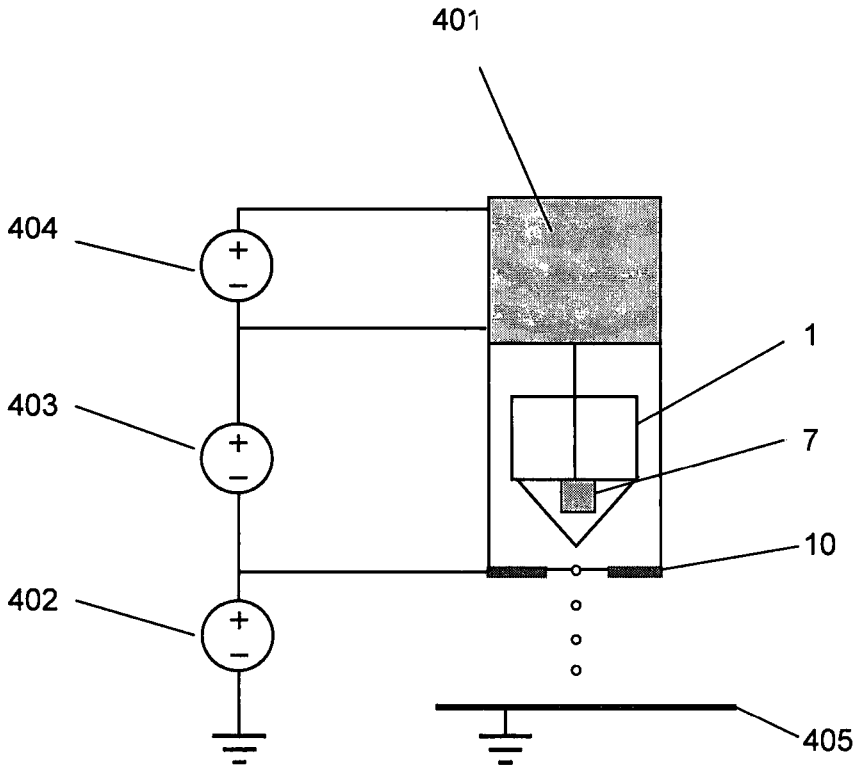
Figure 4 (Prior art)
FIG. 4 is a schematic diagram of a known configuration of the power supplies and electronics which drive the electrostatic printhead.

FIG. 4 is schematic diagram of a known configuration of the power supplies and electronics which drive an electrostatic printhead 1. Three voltages are generated by the three power supplies respectively:

- The IE supply 402 produces a steady voltage of typically 600V with respect to ground that creates an electric field from the intermediate electrode 10 to the print substrate 405 or backing electrode to accelerate the printed droplets across the printhead to substrate gap to the substrate 405.
- The Bias supply 403, with its negative terminal referenced to the IE supply 402, produces a steady voltage of typically 1,000V between the ejection electrode 7 and the intermediate electrode 10. The electric field that this creates is sufficient to move the ink meniscus forward to the ejection point and concentrate colorant particles at the ejection point, but not to cause ejection of the colorant.
- The Pulse supply 404 produces a steady voltage of typically 300V with respect to the bias voltage.

Figure 7:
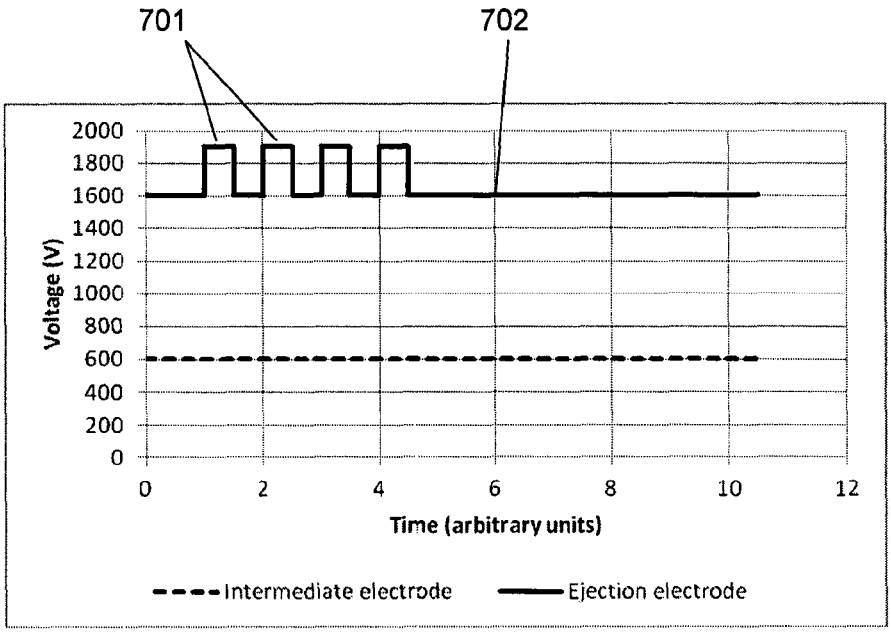
FIG. 7 is a plot of voltage against time illustrating typical voltages on the ejection electrode and intermediate electrode during printing.

The drive electronics 401 act to switch the ejection electrode 7 of each channel of the printhead 1 between the bias voltage and the pulse voltage when the image data determines that a pixel is to be printed, as illustrated in FIG. 7. The voltage pulse 701 thus formed adds to the amplitude of the electric field between the ejection electrode 7 and the intermediate electrode 10, causing it to exceed the threshold at which ejection will occur. Ink is ejected for the duration of the voltage pulse.

When the print data is such that no ejection is required, the ejection electrode remains at the bias voltage 702.

Figure 4A:
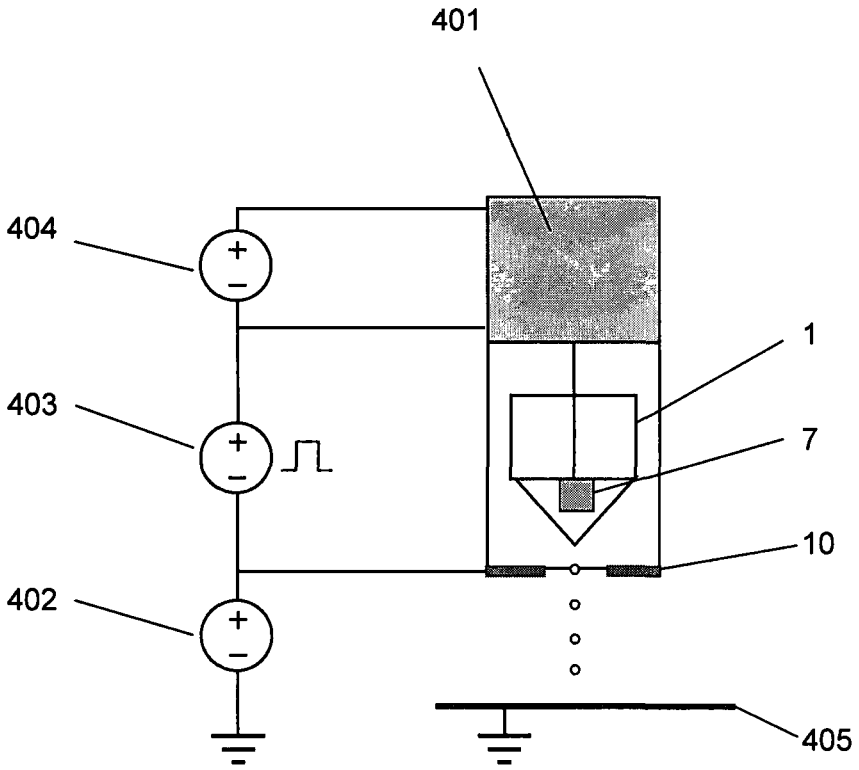
FIG. 4*a* is a schematic diagram showing a modification of the known system of FIG. 4.

FIG. 4*a* is a schematic diagram showing a modification of the known system of FIG. 4, wherein the voltage of the bias supply 403 can be reduced.

The voltage produced by the bias supply may be reduced in magnitude or even controlled to be zero when the printhead is not printing, only increasing the voltage produced by the bias supply to its normal operational level at the last moment before printing.

This shows some benefit for start-up over maintaining the voltage produced by the bias supply continuously at the normal operational level. Reducing the voltage produced by the bias supply causes a reduction in the electric field at the ejection point of the printhead leading to a reduction in ink concentration at the ejection point. This in turn reduces the accumulation of concentrated ink at the ejection point.

However, this may not solve the problem fully as a layer of concentrated ink may still occur. Even if the voltage produced by the bias supply is controlled to be zero, meaning there is no electric field at the ejection point, some unwanted accumulation of ink particles may have occurred that can make the printhead slow to respond to the start of printing an image.

The above outlined reduction in the electric field reduces the electrophoretic force exerted on the ink particles, allowing the concentration gradient to reduce the concentration of ink particles at the ejection point through diffusion and coulombic repulsion. Where the voltage of the bias supply has been controlled to zero, the reduction, of concentration at the ejection point will continue until the ink particles reach a uniform concentration in the carrier fluid.

It is conceivable that the voltage of the bias supply of FIG. 4*a* may be inverted thus reversing the electric field at the ejection point. In this instance the electrophoretic force induced by the electric field would actively cause the charged particles to move away from the ejection point, reducing the concentration of ink at the ejection point below the concentration which would occur when no electric field is applied.

Figure 5:
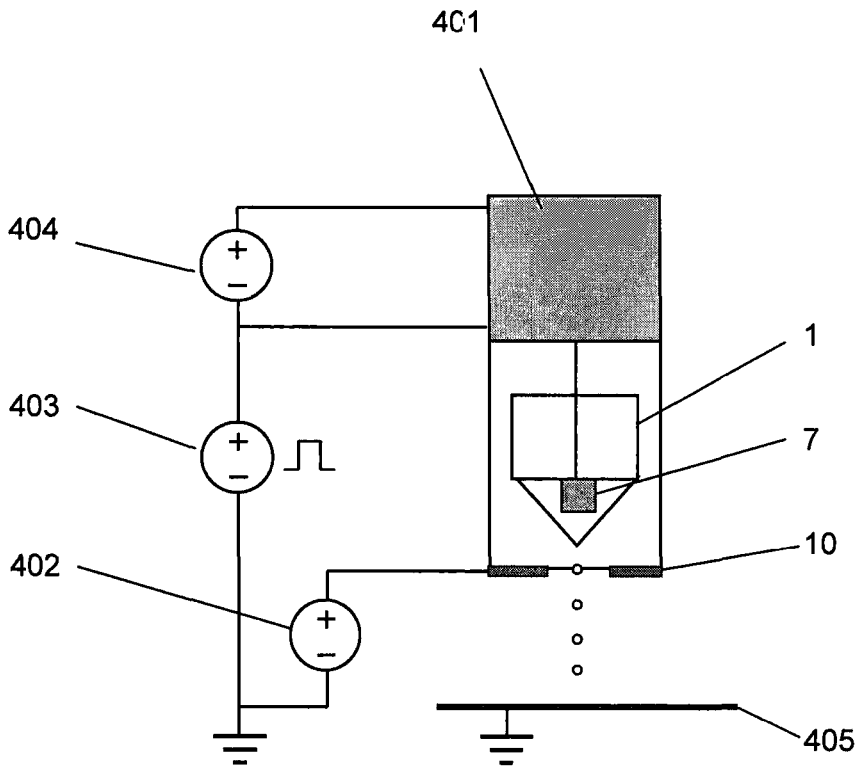
FIG. 5 is schematic diagram showing the configuration of the power supplies and electronics which drive an electrostatic printhead representing an aspect of the present invention.

FIG. 5 is schematic diagram showing the configuration of the power supplies and electronics which drive an electrostatic printhead representing an aspect of the present invention.

Figure 8:
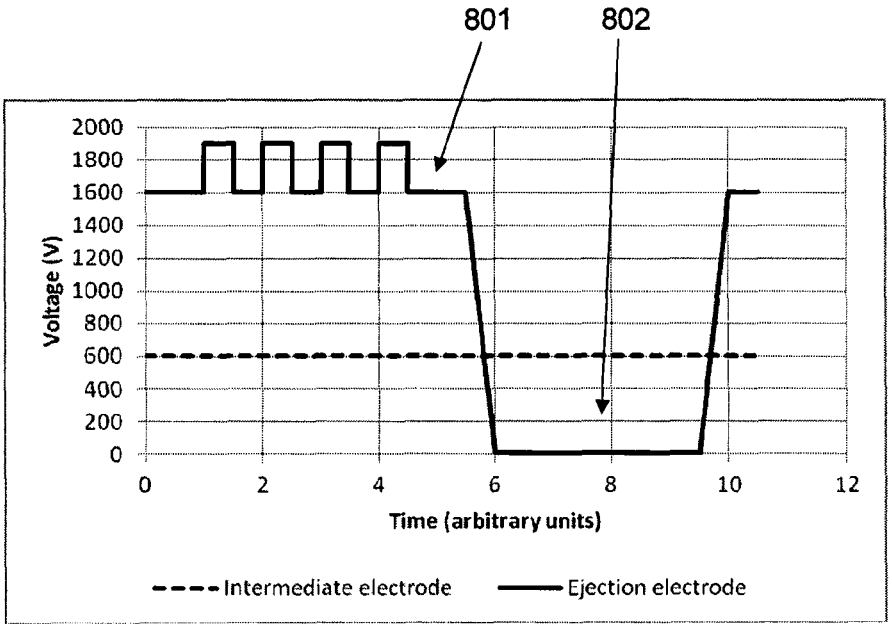
FIG. 8 is a plot of voltage against time showing the reduction of the bias voltage to 0 V during a non-printing phase of printhead operation.

There are two modifications to the circuit of FIG. 4:

- The negative terminal of the bias supply 403 is referenced to ground instead of to the IE supply 402.
- The bias supply 404 is controlled to produce an output voltage of typically 1,600V in the "printing" state or "ready to print" state (to create the same potential difference between the ejection electrode 7 and intermediate electrode 10 as in the prior art) and a voltage lower than the IE voltage in the "reverse bias" or "non-printing" state, which may be as low as 0V (FIG. 8).

In this way, the electric field between the ejection electrode 7 of each printhead channel and the intermediate electrode 10 is reversed in polarity by switching the bias supply from the "printing" or "ready to print" state 801 to the "reverse bias" or "non-printing" state 802.

Reversing the electric field induces an electrophoretic force which actively causes the charged particles to move away from the ejection point, reducing the concentration of ink at the ejection point below the concentration which would occur when no electric field is applied.

The control of the bias supply may be done via a software interface which sets the output to the desired voltage at any point in time, and/or which switches the supply off in a non-printing phase.

The polarity of the bias voltage difference between the printhead ejection electrodes and the intermediate electrode is reversed during periods when the printhead is not required to print, if such periods exist; for example, between objects to be printed or between sheets of a sheet-fed printing system. If there is sufficient time between prints to cause the unwanted accumulation of ink at the ejection points to occur, the bias voltage can be reversed during this time. If there is no non-printing time, i.e. printing, is continuous, it is unnecessary to reverse the bias voltage.

The reversal of electric field polarity preferably occurs whenever the printer is in a non-printing phase for longer than 0.01 seconds. This ensures that any build-up of ink at the ejection point is prevented.

Reversing the polarity of the bias voltage reverses the polarity of the electric field at the ejection points in the printhead. This field normally acts to force the colorant particles suspended in the ink towards the ejection point, creating a concentration of particles at the ejection point. When a channel prints, this concentration of particles is ejected from the head to the substrate. However, as has already been discussed, if a channel is not required to print for a period time, evaporation may cause a layer of concentrated ink to form which can impede the ejection of ink when the channel is next called upon to print.

Reversal of the bias voltage while the concentrated ink is still mobile will move it away from the ejection point, back into the circulating flow of ink, keeping the area comprising the ejection point clear, preventing the build-up of ink.

Ideally the duration of the reversal of electric field polarity is between 0.01 and 1 second. More specifically the duration of the reversal of electric field polarity is between 0.05 and 0.2 seconds.

By reversing the polarity for a period of time within this range the above outlined effect of doing so can be expected to have taken place.

Figure 6:
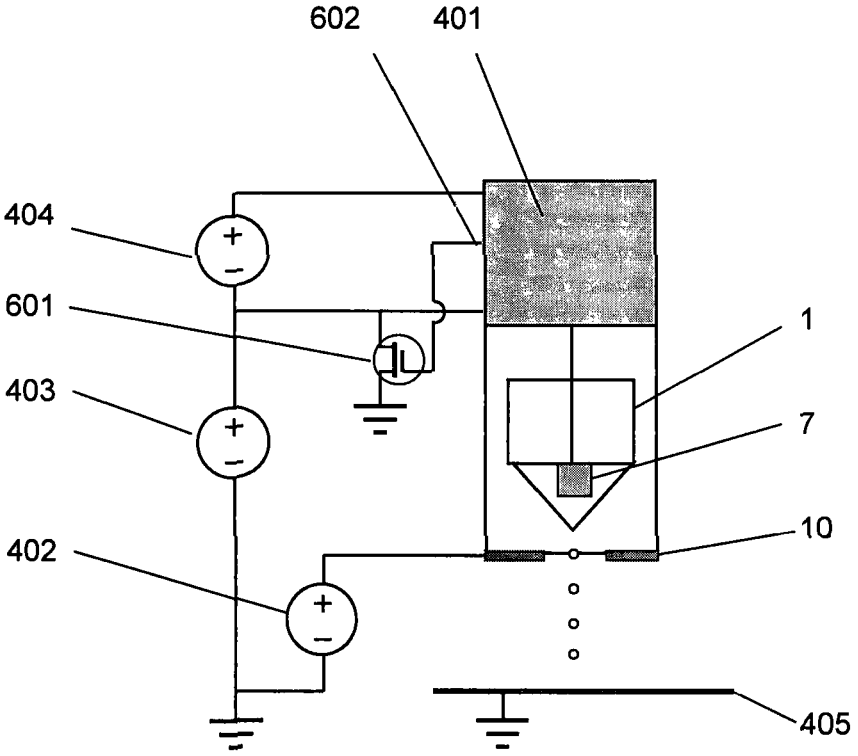
FIG. 6 is schematic diagram showing the configuration of the power supplies and electronics which drive an electrostatic printhead representing a further aspect of the present invention.

FIG. 6 is schematic diagram showing the configuration of the power supplies and electronics which drive an electrostatic printhead representing a further aspect of the present invention.

The particular implementation of the invention shown in FIG. 6 includes a further modification to the circuit of FIG. 5. A clamping transistor 601 is built into the printhead drive electronics 401 which can act to short-circuit the bias supply 403 to ground in order to achieve the reverse bias state. The bias supply 403 is a high-voltage, low-current supply that is designed to go into a controlled, current-limited state when its output is short-circuited to ground.

The advantage of using this method is that the change in voltage at the printhead 1 can be achieved quickly, no modification of the power supply is required and the control signal 602 to switch the bias reversing transistor 601 on and off can be derived from control signals that are already present at the printhead drive electronics 401.

The above description applies to an electrostatic inkjet printer that is configured to eject positively charged inks. That is, inks that contain positively charged particles, which are concentrated and ejected from the printhead by the action of an electrical potential that is positive at the ejection electrode with respect to the intermediate electrode and the substrate. However, the invention applies equally well to a printer configured to eject negatively charged inks, which is accomplished by using power supplies of reversed polarity whereby the intermediate electrode is held at a negative voltage with respect to the substrate and ground, and the ejection electrode is biased to be negative with respect to the intermediate electrode in the printing phase of operation.

Figure 1:
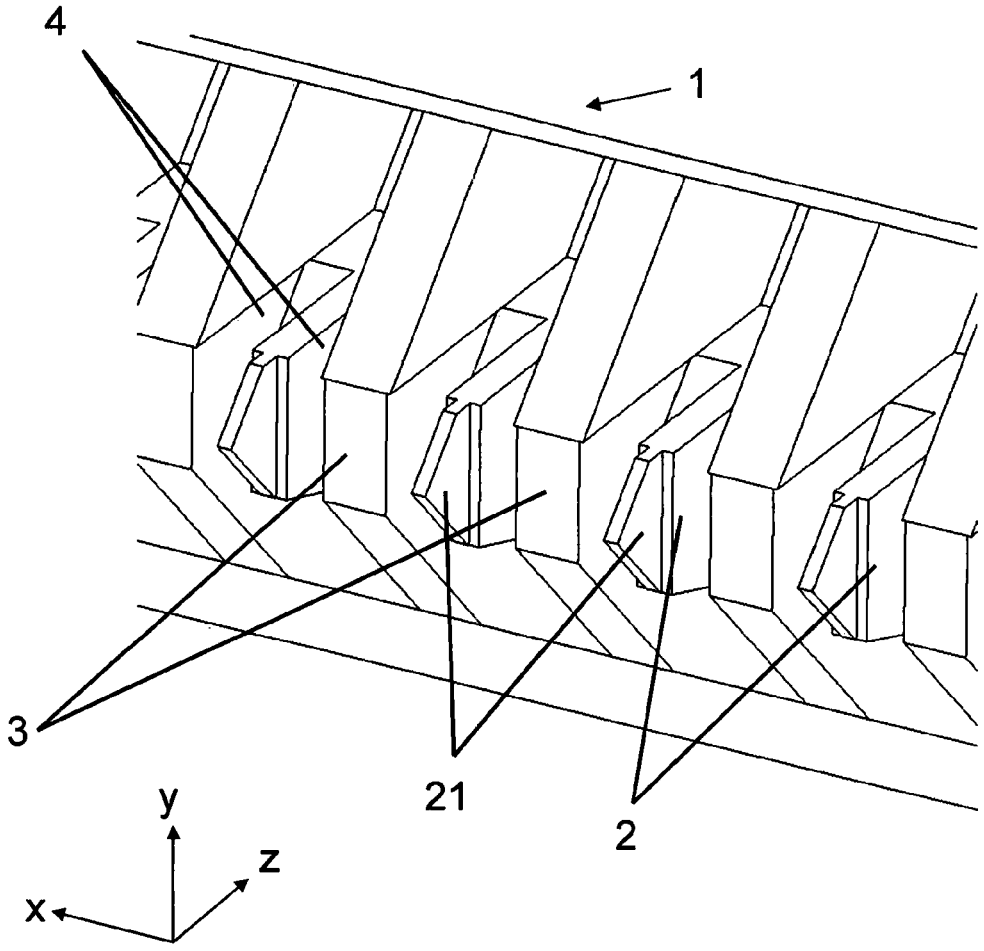
Figure 1 (Prior art)
FIG. 1 is a CAD drawing showing the detail of the ejection locations and ink feed channels for a known electrostatic printhead.
Figure 2:
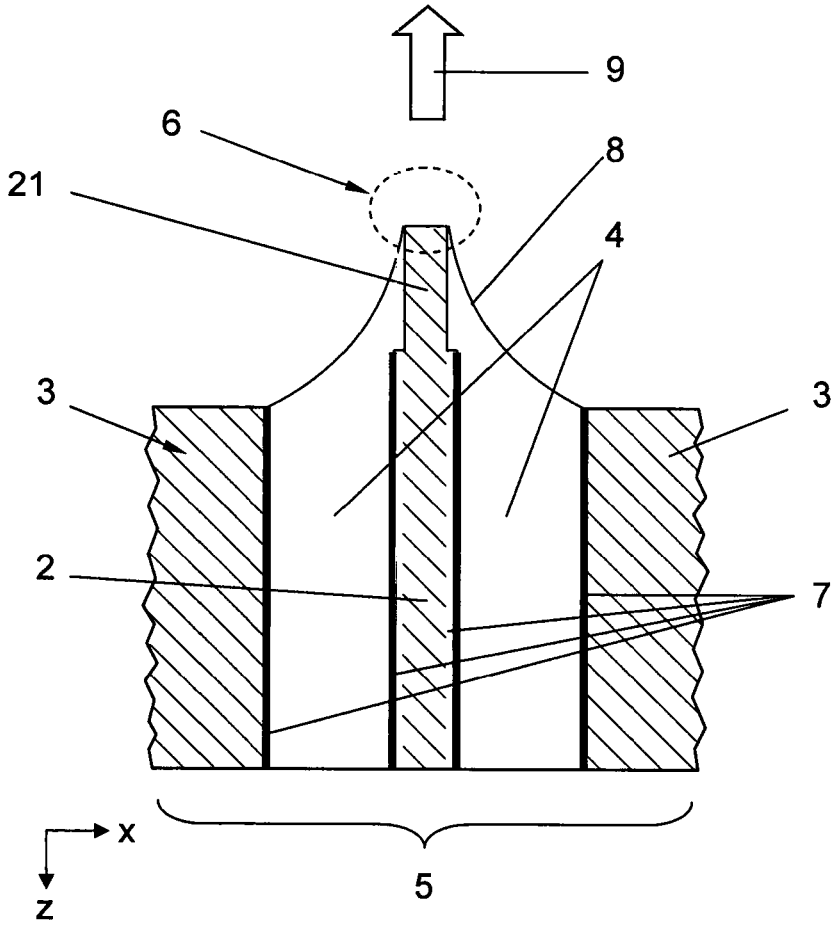
Figure 2 (Prior art)
FIG. 2 is a schematic diagram in the x-z plane of the region around the ejection location in a known electrostatic printhead of the type shown in FIG. 1.
Figure 3:
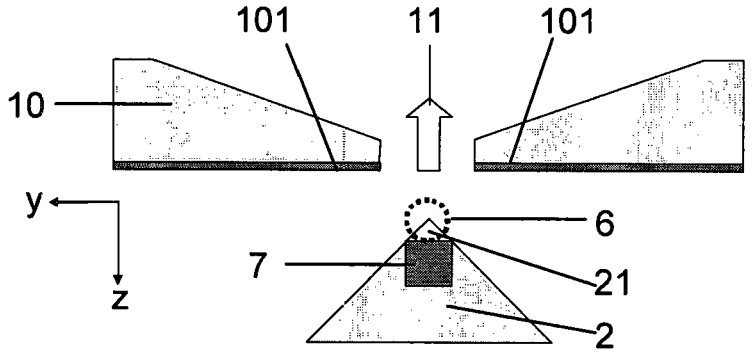
Figure 3 (Prior art)
FIG. 3 is a schematic diagram in the y-z plane of the region around the ejection location in a known electrostatic printhead of the type shown in FIG. 1.

Although the above description generally discusses a printhead with an intermediate electrode, an ejection electrode and a corresponding ejection point, in practice it is common for a printhead to comprise an array of ejection points (as shown in FIG. 1), each ejection point having a corresponding ejection electrode. During operation, each ejection electrode is held at the same bias voltage by a common bias supply when the corresponding ejection point is not required to eject ink, and pulsed individually to a higher, ejection voltage when the corresponding ejection point is required to eject ink to form a printed pixel.

The invention claimed is:

1. A method of reducing or preventing the accumulation of concentrated ink at an ejection point of a printhead of an electrostatic inkjet printer when ink is not being ejected at the ejection point, the printhead comprising:

an ejection electrode; and an intermediate electrode, the printer comprising:

a bias supply for supplying a voltage to the ejection electrode of the printhead; and an intermediate electrode supply for supplying a voltage to the intermediate electrode of the printhead, the method comprising reversing the electric field at the ejection point of the printhead during a non-printing phase of operation to reduce the concentration of ink at the ejection point by short circuiting the bias supply to ground.

2. The method according to claim 1, wherein one of a negative or a positive terminal of the bias supply is referenced to ground.

3. The method according to claim 2, wherein, the negative terminal is referenced to ground where the ink being ejected is positively charged and the positive terminal is referenced to ground where the ink being ejected is negatively charged.

4. The method according to claim 1, wherein the step of reversing the electric field at the ejection point comprises switching the voltage of the bias supply from a printing phase voltage to a non-printing phase voltage.

5. The method according to claim 4, wherein the printing phase voltage of the bias supply is greater than the voltage of the intermediate electrode supply and the non-printing phase voltage of the bias supply is lower than the voltage of the intermediate electrode supply.

6. The method according to claim 1, wherein the electric field at the ejection point is reversed relative to the electric field at the ejection point in a printing phase of operation.

7. The method according to claim 1, wherein the electrostatic inkjet printer further comprises a clamping transistor configured to short-circuit the output of the bias supply to ground.

8. The method according to claim 7, wherein the step of reversing the electric field at the ejection point comprises switching the transistor to short-circuit the bias supply to ground.

9. A method of reducing or preventing the accumulation of concentrated ink at an ejection point of a printhead of an electrostatic inkjet printer when ink is not being ejected at the ejection point, the printhead comprising:

an ejection electrode; and an intermediate electrode, the printer comprising:

a bias supply for supplying a voltage to the ejection electrode of the printhead;

an intermediate electrode supply for supplying a voltage to the intermediate electrode of the printhead, the method comprising reducing the electric field at the ejection point of the printhead during a non-printing phase of operation to reduce the concentration of ink at the ejection point by short circuiting the bias supply to ground.

10. The method according to claim 9, wherein the electric field at the ejection point is reduced to zero.

11. The method according to claim 9, wherein the electric field at the ejection point is reversed.

12. The method according to claim 9, wherein one of a negative or a positive terminal of the bias supply is referenced to ground.

13. The method according to claim 12, wherein, the negative terminal is referenced to ground where the ink being ejected is positively charged and the positive terminal is referenced to ground where the ink being ejected is negatively charged.

14. The method according to claim 9, wherein the step of reducing the electric field at the ejection point comprises switching the voltage of the bias supply from a printing phase voltage to a non-printing phase voltage.

15. The method according to claim 14, wherein the printing phase voltage of the bias supply is greater than the voltage of the intermediate electrode supply and the non-printing phase voltage of the bias supply is lower than the voltage of the intermediate electrode supply.

16. The method according to claim 9, wherein the electric field at the ejection point is reduced relative to the electric field at the ejection point in a printing phase of operation.

17. An electrostatic inkjet printer comprising:

a printhead comprising:

an ejection electrode; and an intermediate electrode, the electrostatic inkjet printer further comprising:

a bias supply for supplying a voltage to the ejection electrode;

an intermediate electrode supply for supplying a voltage to the intermediate electrode; and a controller arranged to short-circuit the bias supply to ground thereby reversing or reducing the electric field at an ejection point of the printhead.

18. The electrostatic inkjet printer of claim 17, wherein the bias supply is controllable by a software interface which sets the output to a desired voltage at any point in time.

19. The electrostatic inkjet printer of claim 17, wherein one of a negative or a positive terminal of the bias supply is referenced to ground.

20. The electrostatic inkjet printer of claim 19, wherein the negative terminal is referenced to ground where the ink is positively charged and the positive terminal is referenced to ground where the ink being ejected is negatively charged.

21. The electrostatic inkjet printer of claim 17, wherein the bias supply is controllable by a software interface which switches the supply off in a non-printing phase.

22. The electrostatic inkjet printer of claim 17, further comprising a clamping transistor configured to short-circuit the bias supply to ground.

* * * * *